United States Patent [19]

Sonoda

[11] 4,155,024

[45] May 15, 1979

[54] IMAGE TUBE HAVING OUTPUT FLUORESCENT SCREEN COATED WITH POROUS AND SOLID ALUMINUM LAYERS

[75] Inventor: Tomiya Sonoda, Machida, Japan

[73] Assignee: Tokyo Shibaura Electric Co., Ltd., Kawasaki, Japan

[21] Appl. No.: 803,349

[22] Filed: Jun. 3, 1977

[51] Int. Cl.[2] ..... H01J 39/00; H01J 39/18

[52] U.S. Cl. ..... 313/102; 313/101; 313/466

[58] Field of Search ..... 313/466, 398, 102; 427/69

[56] References Cited

U.S. PATENT DOCUMENTS

| | | | |
|---|---|---|---|
| 2,533,809 | 12/1950 | Hushley et al. | 427/69 X |
| 2,960,416 | 11/1960 | Reed | 427/69 |
| 3,278,326 | 10/1966 | McGee | 313/466 X |
| 3,574,663 | 4/1971 | Schniepp | 427/69 X |
| 3,582,390 | 6/1971 | Saulnier | 427/69 |
| 3,657,596 | 4/1972 | Goetze et al. | 313/95 X |

*Primary Examiner*—Robert Segal

*Attorney, Agent, or Firm*—Cushman, Darby & Cushman

[57] ABSTRACT

An image tube equipped with a fluorescent screen comprising a phosphor layer coated on a transparent substrate, a conductive porous substance layer formed on the surface of the phosphor layer, and a conductive solid substance layer formed on the surface of the porous layer. The image tube exhibits improved contrast and brightness.

3 Claims, 3 Drawing Figures

IMAGE TUBE HAVING OUTPUT FLUORESCENT SCREEN COATED WITH POROUS AND SOLID ALUMINUM LAYERS

BACKGROUND OF THE INVENTION

This invention relates to an image tube, particularly to the one equipped with an improved output fluorescent screen.

In general, a fluorescent screen of an image tube is prepared by tightly depositing phosphor particles on a transparent substrate by precipitation, slurry coating, electrodeposition, etc., followed by coating the surface of the resultant phosphor layer with a thin film of metal or the like. The fluorescent screen is deeply related with the properties of the image tube, particularly, with the improvement of brightness, resolution and contrast.

Appended FIG. 1 shows an X-ray image intensifier as an example of the conventional image tube. As shown in the drawing, the intensifier comprises an evacuated envelope 1 made of glass and an input screen 2 disposed on the input side of the envelope 1. The input screen 2 comprises a substrate 3, a phosphor layer 4 and a photocathode 5. The substrate is formed of a curved plate having a predetermined curvature and is mounted in the envelope 1. It is seen that the convex surface of the substrate 3 faces the input side of the envelope. The phosphor layer 4 is made of cesium iodide, which contains sodium as an activator. As shown in the drawing, this layer is formed on the concave surface of the substrate in a thickness of 100 to 250 $\mu$. The photocathode 5 is formed on the surface of the phosphor layer 4.

Accelerating electrodes 7 and an output fluorescent screen 8 are mounted on the output side of the envelope 1. Further, focussing electrodes 6 are provided adjacent to the inner wall of the envelope 1.

When an X-ray 9 is incident on the input screen 2, the phosphor layer 4 is caused to fluoresce. Namely, the X-ray 9 is converted to light. Further, the light emitted from the phosphor layer 4 is converted to electron by the photocathode 5, resulting in photoemission from the photocathode. The photoelectron emitted from the photocathode is then accelerated by the accelerating electrodes 7 while being focussed by the focussing electrodes 6, thereby causing the output fluorescent screen 8 to fluoresce. In short, the X-ray image incident on the input screen is reproduced on the output screen as a optical image. In this case, the reproduced optical image is reduced in size to about one-tenth of the original X-ray image. Further, the photoelectron is accelerated by the accelerating electrodes 7. Those combine to render the optical image on the output screen several thousand times as bright as the image on the input screen.

FIG. 2 shows a cross section of the output fluorescent screen of the X-ray image intensifier outlined above. As shown in the drawing, the output screen comprises a transparent substrate 10, a phosphor layer 12 and an aluminum film 13. The phosphor layer 12 is formed by depositing phosphor particles 11 sized at 0.2 to 3$\mu$ on the transparent substrate 10 in a thickness of about 5 to 15$\mu$. In this case, the packing density of the phosphor particles is about 40%. On the other hand, the aluminum film 13 is formed by vacuum deposition. To be more specifically a nitrocellulose thin film is formed first on the surface of the phosphor layer 12, followed by vacuum deposition of aluminum in vacuum of about $10^{-5}$ torr to form an aluminum layer having a thickness of 3,000 to 4,000Å. Finally, heating is effected under the air atmosphere so as to remove the nitrocellulose film.

What should be noted is that the aluminum film is formed by depositing aluminum atoms on the nitrocellulose film formed on the surface of the phosphor layer having a packing density of phosphor particles as low as about 40%. Naturally, the aluminum film is rendered rough. In addition, the nitrocellulose film is removed by heating. It follows that the bonding strength is negligible between the aluminum layer and the phosphor particles facing the aluminum layer.

The photoelectron emitted from the input screen 2 (FIG. 1) is accelerated and focussed to pass through the aluminum film 13, thereby causing the phosphor particles 11 to fluoresce and reproducing the X-ray image as an optical image. The optical image thus formed can be observed through the transparent substrate 10 and an output window of the envelope 1.

The following drawbacks are inherent in the conventional output fluorescent screen of the image tube described above:

1. Since the aluminum film 13 is high in reflectance, the light emitted by the phosphor particles 11 is reflected and scattered by the aluminum film 13, resulting in an unsatisfactory contrast and a low resolution.

2. The aluminum film 13 is formed by vapor deposition on a nitrocellulose film formed on the surface of the phosphor layer 12. Since the phosphor layer 12 is porous and has a rough surface, the nitrocellulose film also comes to have a rough surface. Naturally, the aluminum film 13 formed on the nitrocellulose film becomes uneven in thickness with respect to the direction in which the light emitted by the phosphor layer travels. It follows that the light emitted by the phosphor layer partly penetrates the aluminum layer to reach the photocathode of the input screen, resulting in that photoelectron is emitted again from the photocathode of the input screen. This brings about deterioration of contrast and resolution.

3. The problem mentioned in item 2 may be avoided by thickening the aluminum film 13. In this case, however, the aluminum film tends to peel off the phosphor layer 12. In addition, the thickened film obstructs the passage of the photoelectron therethrough, leading to a decreased brightness of the resultant optical image.

SUMMARY OF THE INVENTION

An object of this invention is to provide an image tube equipped with an output fluorescent screen capable of preventing the conductive thin film from peeling off the phosphor layer and permitting improved resolution and brightness of the optical image. Naturally, the above-noted drawbacks inherent in the conventional fluorescent screen are eliminated by this invention.

The image tube according to this invention comprises an output phosphor screen composed of a phosphor layer coated on a transparent substrate, a conductive porous substance layer formed on the phosphor layer and a conductive solid substance layer formed on the conductive porous substance layer.

PREFERRED EMBODIMENT OF THE INVENTION

Figure 1:
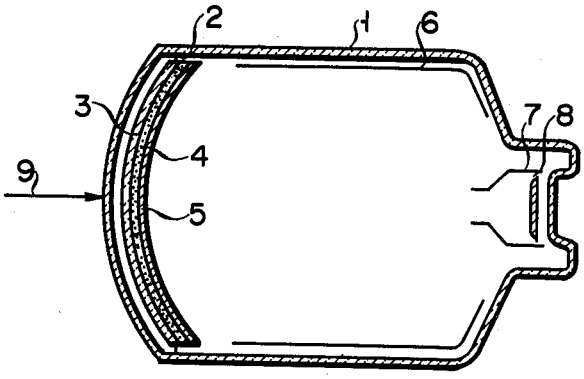
FIG. 1 schematically shows the construction of the conventional X-ray image intensifier.
Figure 2:
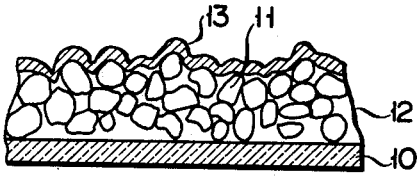
FIG. 2 is a cross sectional view of the output fluorescent screen of the intensifier shown in FIG. 1.

This invention is based on the finding that it is very advantageous to provide a conductive porous substance layer on the surface of the phosphor layer of a fluorescent screen. Specifically, it has been found that the porous layer is attached very tight to the phosphor layer and permits an improved light shielding effect. Where a conductive solid substance layer is formed directly on the surface of the phosphor layer as in the prior art, it is considered that stresses are concentrated on the interface between the phosphor layer and the conductive layer and that the conductive layer tends to peel off the phosphor layer. But, stresses do not concentrate on the interface mentioned if a conductive porous substance layer is formed on the phosphor layer. Further, particles of the conductive layer are engaged with the rough surface of the phosphor layer, resulting in an increased contact area between the conductive layer and the phosphor layer. Thus, the conductive layer does not peel off the phosphor layer.

In this invention, a conductive solid substance layer is further formed on the conductive porous substance layer. Namely, the phosphor screen of this invention comprises a phosphor layer, a conductive porous substance layer formed on the phosphor layer, and a conductive solid substance layer formed on the porous layer. Leakage of light can be prevented sufficiently by the porous layer alone. But, the solid substance layer is effective for preventing the phosphor layer form damaging by alkali metal vapor. Specifically, alkali metal vapor generated in the step of forming a photocathode within the image tube passes through the conductive porous substance layer to reach the phosphor layer, unless the conductive solid substance layer is formed on the porous layer.

It is difficult to make a clear distinction between the porous substance layer and the solid substance layer in terms of packing density of the particles, etc. However, the distinction can be made on the basis of the degree of vacuum under which the conductive layer is formed by vapor deposition. Where the conductive layer is made of, for example, aluminum, the deposition layer formed under a vacuum of $10^{-5}$ to $10^{-4}$ torr corresponds to the solid layer and the deposition layer formed under $2\times10^{-3}$ to $2\times10^{-2}$ torr corresponds to the porous layer. Microscopic observation of the solid layer thus defined presents a uniform film-like appearance, with no granularity recognized. Incidentally, the packing density of particles is in the vicinity of 100% for the solid layer and is about 40 to 60% for the porous layer thus defined.

It is preferred that the amount of the conductive material deposited on the phosphor layer be 54 to 81 $\mu g/cm^2$ of the surface area of the phosphor layer including both porous and solid layers. It is also preferred that the amount of the conductive material constituting the porous layer be at least 13.5 $\mu g/cm^2$. Naturally, the conductive layer is more tightly attached to the phosphor layer in accordance with increase in percentage of the porous layer relative to the total amount of the porous and solid layers. Incidentally, the porous and solid layers are made clearly distinctive if formed separately under differing degrees of vacuum. Of course, the conductive layer of this type is satisfactory in this invention. But, it is also satisfactory to form the conductive layer such that the packing density thereof increases consecutively or in stepwise fashion from the interface with the phosphor layer toward the surface of the conductive layer.

Figure 3:
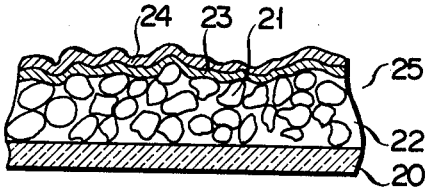
FIG. 3 is a cross sectional view of an output fluorescent screen of an X-ray image intensifier according to one embodiment of this invention.

FIG. 3 shows schematically a cross section of an output phosphor screen according to one embodiment of this invention. In the drawing, reference numerals 20, 21 and 22 denote, respectively a transparent substrate, phosphor particles sized at 0.2 to 3$\mu$, and a phosphor layer 10$\mu$ thick on the average and consisting of the phosphor particles. The substrate 20 is a disc having a diameter of 55 mm and the phosphor layer 22 is coated on the substrate 20 in the form of a circle having a diameter of 40 mm. Namely, the peripheral portion of the substrate is not coated with the phosphor layer.

A porous layer 23 made of a conductive material, for example, aluminum is further coated on the phosphor layer 22. Naturally, the material of the porous layer 23 transmits an electron beam. The porous layer 23 extends to cover the peripheral portion of the substrate 20 which is not coated with the phosphor layer 22. The porous layer is further coated with a solid layer 24 made of the same material as that of the porous material. Needless to say, the layers 23 and 24 combine to provide a conductive layer 25.

The conductive layer 25 exhibits an excellent shielding effect of light. Actually, the light emitted by the phosphor layer 22 scarcely passes through the conductive layer 25. Otherwise, the light scatters within the image tube and arrives at the photocathode of the input screen so as to generate again photoelectron. It follows that an image tube equipped with the output phosphor screen as shown in FIG. 3 permits a markedly improved contrast.

Incidentally, a porous layer exhibits a prominently high shielding effect of light compared with a solid layer. For example, the required amount of conductive material constituting a porous layer having a packing density of about 50% is half the amount for a solid layer having a packing density of about 100% in order to obtain the same light shielding effect. Owing to the excellent light shielding effect mentioned, the conductive layer may be formed of a small amount of conductive material. Naturally, the transmission of photoelectron through the conductive layer is scarcely obstructed and, thus, the brightness of the resulting optical image is kept satisfactorily high. It follows that the output fluorescent screen according to this invention can be applied to an image tube in which the accelerating voltage of the photoelectron is relatively low.

Incidentally, known is a cathode ray tube in which a porous layer of a heat-absorptive material is formed on a solid aluminum layer in order to cool a shadow mask disclosed in the U.S. Pat. No. 3,392,297. In this invention, however, a solid layer is formed on a porous layer in contrast to the prior art mentioned.

As described in detail, this invention provides an image tube such as, for example, an X-ray phosphor amplifier equipped with an output fluorescent screen having a conductive thin film tightly attached to the phosphor layer. The image tube of this invention exhibits markedly improved contrast and brightness of the optical image.

What is claimed is:

1. An image tube equipped with an output fluorescent screen comprising a phosphor layer coated on a transparent substrate, a conductive porous substrate layer formed on the surface of the phosphor layer and a conductive solid substance layer formed on the surface of the conductive porous substance layer, the porous and solid layers being formed of aluminum wherein the total amount of aluminum is 54 to 81 micrograms per square centimeter of the surface area of the phosphor layer and the amount of aluminum constituting the porous layer is at least 13.5 micrograms per square centimeter of the surface area of the phosphor layer.

2. The image tube according to claim 1, wherein the packing density of particles of the conductive substance increases in step-wise fashion from the interface between the conductive layer and the phosphor layer toward the upper surface of the conductive layer.

3. The image tube according to claim 1, wherein the packing density of particles of the conductive substance consecutively increases from the interface between the conductive layer and the phosphor layer toward the upper surface of the conductive layer.

* * * * *